US011685971B2

(12) United States Patent
Sherman et al.

(10) Patent No.: US 11,685,971 B2
(45) Date of Patent: Jun. 27, 2023

(54) DEGRADABLE HIGH-STRENGTH ZINC COMPOSITIONS AND METHOD OF MANUFACTURE

(71) Applicant: Terves Inc., Euclid, OH (US)

(72) Inventors: Andrew Sherman, Mentor, OH (US); Josh Caris, Euclid, OH (US); Nicholas Farkas, Euclid, OH (US); Gabriel Santillan, Euclid, OH (US)

(73) Assignee: TERVES, LLC, Euclid, OH (US)

( * ) Notice: Subject to any disclaimer, the term of this patent is extended or adjusted under 35 U.S.C. 154(b) by 353 days.

(21) Appl. No.: 16/392,139

(22) Filed: Apr. 23, 2019

(65) Prior Publication Data

US 2019/0345585 A1 Nov. 14, 2019

Related U.S. Application Data

(60) Provisional application No. 62/669,546, filed on May 10, 2018.

(51) Int. Cl.

| | |
|---|---|
| ***C22C 18/04*** | (2006.01) |
| ***C22C 1/04*** | (2023.01) |
| *C22F 1/16* | (2006.01) |

(52) U.S. Cl.

CPC ..... *C22C 18/04* (2013.01); *C22C 1/0483* (2013.01); *C22F 1/165* (2013.01)

(58) Field of Classification Search

CPC ..... B22F 2005/001; B22F 2005/002; B22F 2301/30; C22F 1/165; C22C 1/0483; C22C 1/0491; C22C 18/00; C22C 18/02; C22C 18/04; C22C 32/0042; C22C 23/04; C22C 30/06

See application file for complete search history.

(56) References Cited

U.S. PATENT DOCUMENTS

| | | | | |
|---|---|---|---|---|
| 3,527,601 | A * | 9/1970 | Foerster | C22C 18/00 419/48 |
| 4,126,450 | A * | 11/1978 | Lathrop | C22C 18/04 420/516 |
| 8,211,248 | B2 | 7/2012 | Marya | |
| 8,770,261 | B2 | 7/2014 | Marya | |
| 9,757,796 | B2 | 9/2017 | Sherman et al. | |
| 2015/0239795 | A1 | 8/2015 | Doud et al. | |
| 2015/0240337 | A1* | 8/2015 | Sherman | B22D 21/007 420/408 |
| 2015/0299838 | A1 | 10/2015 | Doud et al. | |
| 2017/0165745 | A1* | 6/2017 | Salinas | B22D 18/06 |

FOREIGN PATENT DOCUMENTS

| | | | | |
|---|---|---|---|---|
| CN | 108533214 A * | 9/2018 | | C22C 18/00 |

OTHER PUBLICATIONS

Robert J. Barnhurst, "Zinc and Zinc Alloys," ASM Handbook, vol. 2: Properties and Selection: Nonferrous Alloys and Special-Purpose Materials, 1990, pp. 527-542. (Year: 1990).*

* cited by examiner

*Primary Examiner* — Vanessa T. Luk
(74) *Attorney, Agent, or Firm* — Ulmer & Berne LLP; Brian E Turung

(57) ABSTRACT

A degradable, high-strength zinc composition suitable for use in producing degradable tools and components for in use in oil and gas and related application fields.

17 Claims, 4 Drawing Sheets

Alloy $ZnAl_2Cu_5Sn_3Pb_1Ca_3Ga_1$ a) as cast and machined, b) after 20.06 hrs. of dissolution testing at 3 wt.% KCl at 90°C.

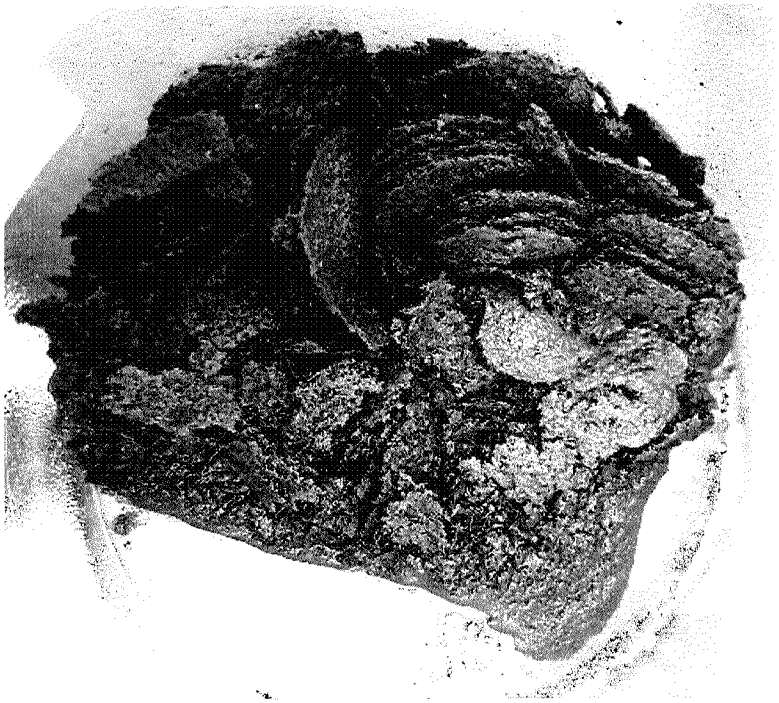
FIG. 2: Alloy $ZnAl_{14}Cu_2Sn_2Pb_2Ca_8Ga_1$ after 3.5 days of testing before drying.

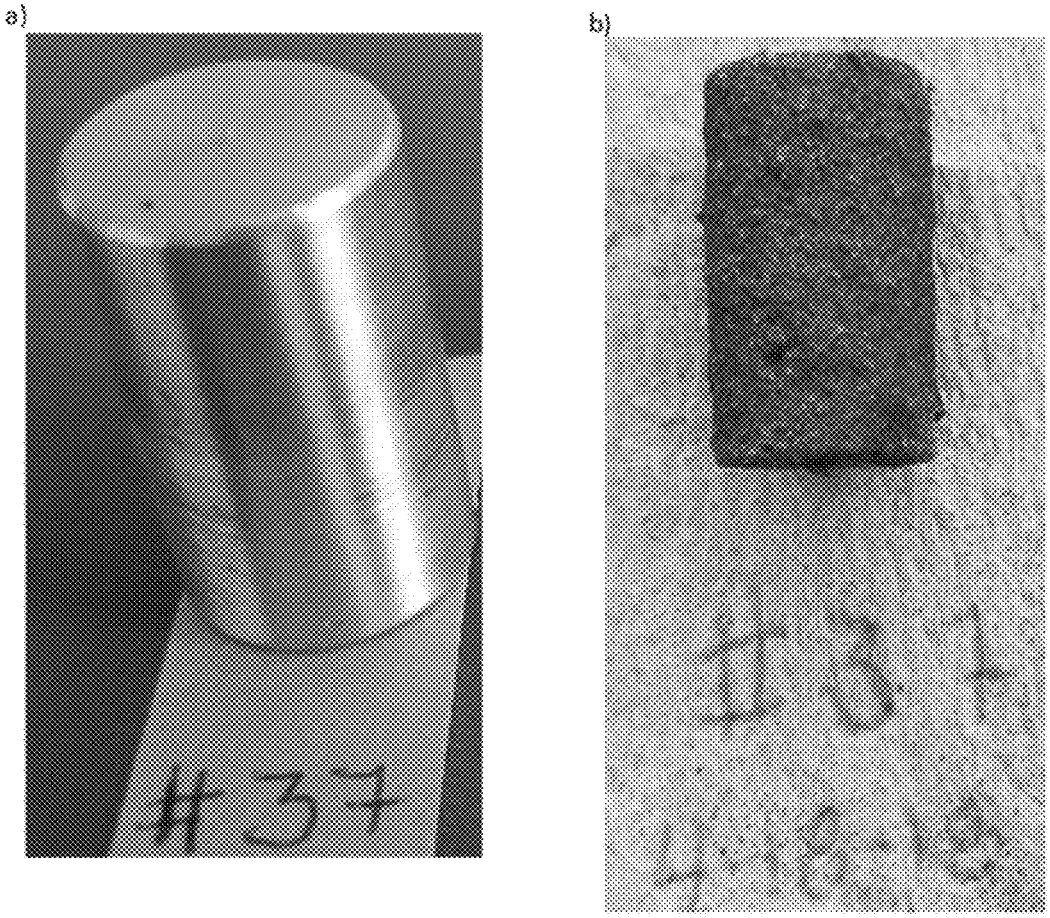
FIG. 3: Alloy $ZnAl_{20}Cu_2Sn_1Pb_1Ca_8Ga_1$, a) as casted and machined; b) after 20.06 hrs. of dissolution testing at 3 wt.% KCl at 90°C.

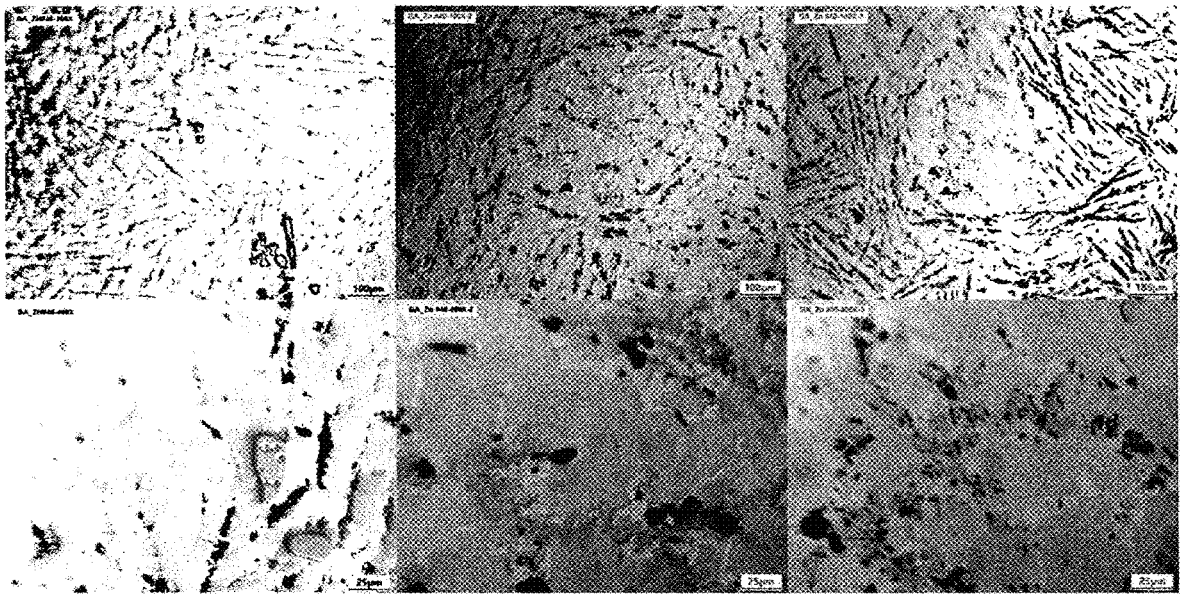
FIG. 4: Microstructure of degradable zinc alloy castings showing galvanically active phases.

DEGRADABLE HIGH-STRENGTH ZINC COMPOSITIONS AND METHOD OF MANUFACTURE

The present invention claims priority on U.S. Provisional Application Ser. No. 62/669,546 filed May 10, 2018, which is incorporated herein by reference.

FIELD OF THE INVENTION

The present invention relates generally to degradable high-strength compositions suitable for use in producing degradable tools and components. In particular, the present invention relates to degradable high-strength compositions suitable for use in producing degradable tools and components for use in the field of oilfield exploration, production, and testing. The present invention also relates to the method for manufacturing degradable high-strength compositions, and their application in oil and gas and related application fields.

BACKGROUND OF THE INVENTION

Structural compositions found in everyday applications (mainly metals and alloys) are required to be durable over the intended lifetime of a component that is fully or partially formed of the structural composition; i.e., the structural composition should be substantially or fully chemically inert, or not reactive (even though many rust or corrode) over the intended lifetime of a component. For temporary use applications, corrosion resistance and durability of the structural composition is not desired; rather, controlled degradation is desired. The use of these structural compositions for use in temporary applications has rapidly expanded in the oil and gas industry. Examples of such structural compositions for use in temporary applications include galvanically-active aluminum and zinc alloys, which alloys may also contain water-reactive Group 1 and 2 metals. Similar to aluminum and magnesium, zinc can be used as an active material to galvanically protect steel structures. However, zinc alloys are generally much less reactive than magnesium and aluminum, and generally provide less protection to corrosion, particularly at higher temperatures or at low chloride contents such as in fresh water or brackish water.

For oil and gas applications, a very high-strength, low cost alloy with controlled degradation rates of 5-150 $mg/cm^2/hr$. (and all values and ranges therebetween), or from 0.5-10 mm/day (and all values and ranges therebetween) would be desirable for use in various structural compositions for use in temporary applications. Generally, useful mechanical properties of the metal alloy are tensile and compressive strengths above 10 KSI, typically above 25 KSI, and more typically above 50 KSI, as well as shear strengths of at least 15 KSI to greater than 35 KSI. Unfortunately, currently available dissolvable metal alloys and polymers do not have such properties. Current dissolvable magnesium alloys are only able to provide shear strengths of 15-20 KSI and tensile strengths of 15-45 KSI; thus, such magnesium alloys cannot be used for many oil and gas applications. Likewise, dissolvable polymers have even lower shear and tensile strengths than magnesium alloys. As such, higher strength degradable alloys are desirable for use in oil and gas application.

Some higher strength aluminum alloys have been described by Marya (See U.S. Pat. Nos. 8,211,248 and 8,770,261). Some nanocomposite alloys have been suggested that are higher in strength to the prior art degradable magnesium alloys. However, these aluminum alloys require the use of costly alloying additives or costly processing methods and, thus, are not economical for large scale use.

Being able to control the dissolution of a downhole well component in a variety of solutions is very important to the utilization of interventionless drilling, production, and completion tools such as sleeves, frac balls, hydraulic actuated tooling, scrapers, valves, screens, perforators, penetrators, knives, grips/slips, and the like. Reactive materials for these applications, which materials dissolve or corrode when exposed to acid, salt, or other wellbore conditions, have been proposed for some time. Incorporated by reference are U.S. Pat. No. 9,757,796 and US Publication Nos. 2015/0299838 and 2015/0239795 which describe techniques for creating and manufacturing dissolvable magnesium alloys through the addition of galvanically-active phases. The prior art teaches that the preparation of magnesium and aluminum degradable metal compositions, as well as degradable polymer compositions, have resulted in rapid commercialization of interventionless tools, including plugs, balls, valves, retainers, centralizers, and other applications. Generally, these tools are formed of or include materials that are engineered to dissolve or corrode. Dissolvable polymers and some powder metallurgy metals are also known in the art.

While these degradable metals and polymer systems have enjoyed success in reducing well completion costs, their lack of ability to 1) withstand deformation, 2) resist corrosion in flowing fluid, or 3) be embedded in steel casings has resulted in such materials not being suitable for a number of desired oil and gas applications. For example, in the production of dissolving frac plugs, ceramic or steel inserts are currently used for gripping surfaces (to set the plug into the steel casing). Requirements for these grips include a hardness higher than the steel casing, and mechanical properties, including compression strength, deformation resistance (to retain a sharp edge). Fracture toughness must be sufficient to withstand the setting operation where the grips are embedded slightly into the steel casing. Other oil and gas applications that include pump down seats are currently fabricated from grey cast iron and need to be milled out. Frac balls or cones having very small overlaps with the seat (1/16" or less) currently have limited pressure ratings with dissolvable materials due to limited swaging or deformation resistance of current materials. Existing degradable metals and polymers typically do not have the required hardness for such applications.

For applications such as seats and valve components, and other sealing surfaces subject to sand or proppant flow, existing magnesium, aluminum, or polymer alloy degradables have insufficient hardness and erosion resistance. In frac ball applications, metallic and polymer degradable balls deform, swage, and shear, limiting their pressure rating in small overlap (e.g., below 1/8" overlap) applications.

Zinc alloys have many of the requisite properties (e.g., high strength, high hardness, low cost, and easy preparation through casting processes) that would be desirable for use in oil and gas applications. Unfortunately, zinc is not as reactive as magnesium or aluminum and is normally passivated in aqueous media. The addition of anodic activators to a zinc alloy, which anodic activators have a greater electronegativity than zinc (e.g., lead, tin, gallium, nickel, copper, iron, cobalt, germanium, silver, and other elements having an electronegativity that is greater than zinc, and generally greater than 1.84) is insufficient to create an actively corroding zinc alloy material. Similarly, the addition of more electropositive additives to the zinc alloy (e.g., aluminum, calcium, magnesium, lithium, sodium, strontium, etc.) is also generally insufficient to control corrosion rates and prevent passivation of the zinc alloy to meet the needs in oil and gas applications. While the addition in sufficiently high amounts of lithium, sodium, calcium, cesium, strontium, barium, potassium, and other water-reactive metals to the zinc alloy can produce a degradable zinc alloy, these zinc alloys 1) do not have satisfactory mechanical properties, 2) are expensive or complex to manufacture or process, and 3) are so reactive as to not be storable and handleable in most applications.

In generic terms, a reactive metal may be defined as 1) a metal that readily combines with oxygen to form stable oxides, 2) a metal that interacts with water and produces diatomic hydrogen, and/or 3) a metal that becomes easily embrittled by interstitial absorption of oxygen, hydrogen, nitrogen, or other non-metallic elements. There are various levels of reactivity between metals, alloys, compositions, or any element listed on the periodic table. For instance, compared to iron or steels (i.e., alloys of iron), aluminum, magnesium, calcium and lithium are reactive, lithium being the most reactive (or least inert) of all four. Reactive metals are grouped in the first two columns of the Periodic Table of the Elements (sometimes referred to as Column I and II elements); i.e., among the alkaline and alkaline-earth elements. Of the alkaline metals (namely lithium, sodium, potassium, rubidium, cesium, francium) and of the alkaline-earth metals (namely beryllium, magnesium, calcium, strontium, barium, radium), few may be directly utilized because they are 1) far too reactive to be handled safely and thus be readily procurable for use for any commercial applications, 2) not sufficiently reactive as they, for instance, passivate in aqueous environments and thus form stable protective barriers (e.g. adherent oxides and hydroxide films), or 3) their rate of reaction or transformation (and thus degradation) is too slow as compared to magnesium, aluminum and their commercial alloys when immersed in cold and neutral water (i.e., neither acidic nor basic; pH=7).

Though less reactive than the alkaline and alkaline-earth metals, aluminum and zinc may be also included among the reactive metals. However, aluminum and particularly zinc do not react or degrade with water nearly to the same extents as the Columns I and II elements since aluminum and zinc are typical materials used in durable elements for applications as diverse as automotive, aerospace, appliances, electrical, decoration, and the like. To quantify reactivity of an element, galvanic corrosion potentials may be used. If such measurement is unavailable (as for instance for any novel composition), such compound can be compared to a reference reaction such as a hydrogen reaction. For example, the higher the potential of a composition with respect to hydrogen, the lesser its reactivity and its likelihood to degrade noticeably or rapidly. Because reactivity of an element is linked to the ease with which chemical reactions proceed with non-metallic elements (e.g., oxygen, nitrogen), electronegativity constitutes an excellent measure of reactivity for Periodic Table elements. Electronegativity and, especially, corrosion potential of aluminum and zinc are sufficiently low compared to the other elements of the Periodic Table to categorize aluminum and zinc as reactive metals rather than a non-reactive, inert or noble metal or element.

In numerous environments, including in the oilfield, it would be advantageous to utilize a component comprised of a reactive composition comprising degradable high-strength zinc alloys that have controlled degradation rate. The compositions of interest are those that degrade by either dissolving, disintegrating, or both when required by the application or the user. The degradation may proceed within minutes, hours, days or weeks depending upon the application requirements. In oilfield environments, typical times for degradation may range from minutes to days, occasionally weeks to a month or two. Among the multitude of oilfield examples that may be foreseen for degradable high-strength zinc alloys is that of a diverter ball. A diverter ball is a solid object that is dropped or pumped through wellbore tubulars in a process known as "diversion" and may be utilized in operations known as "acidizing" and "fracturing". Both acidizing and fracturing are well-known operations to the skilled artisan and require little further explanation. In other well operations, perhaps less well-known than the latter, diverter balls are employed as downhole valves in different fracturing zones by serving as temporary plugs to isolate fluids from different zones. In the present context, the term "ball" extends beyond that typically associated to spherical shapes and includes bars, plugs, darts, and any other shaped members, and is more generally referred to herein as "well operating components".

In view of the current state of the art, there is a need for a degradable high-strength zinc alloy that can be used to controllably dissolve in environments such as in oil and gas applications.

SUMMARY OF THE INVENTION

The present invention relates generally to degradable high-strength metal alloy compositions suitable for use in producing degradable tools and components. In particular, the present invention relates to degradable high-strength metal alloy compositions suitable for use in producing degradable tools and components in the field of oilfield exploration, production, and testing. The present inventions also relates to the method for manufacturing degradable high-strength metal alloy compositions and their application in oil and gas and related application fields.

In one non-limiting aspect of the invention, there is a provided a degradable high-strength zinc alloy, an apparatus that incorporates a degradable high-strength zinc alloy, a method for forming the degradable high-strength zinc alloy, and methods for using an apparatus that incorporates the degradable high-strength zinc alloy.

In another and/or alternative non-limiting aspect of the invention, there is provided a degradable high-strength zinc alloy that includes 1) one or more electropositive alloying additives and/or electronegative galvanic activators, and optionally 2) one or more reactive metals. Compositions of the degradable high-strength zinc alloy may exist in a variety of morphologies, including a 1) degradable zinc alloy processed by casting or powder metallurgy, or 2) degradable zinc alloy that includes various compositions, such as a metal matrix composite.

In another and/or alternative non-limiting aspect of the invention, there is provided a completion device that is partially or fully formed of a degradable high-strength zinc alloy. Non-limiting examples of completion devices include frac balls, sleeves, sleeve systems, flow control devices, diverters, slips and grips, divertor balls, valve balls or plugs, hydraulic actuated tools, scrapers, valves, screens, perforators, penetrators, knives, and other degradable devices.

In another and/or alternative non-limiting aspect of the invention, there is provided a completion device that is partially or fully formed of a degradable high-strength zinc alloy that has a greater strength than completion devices that are partially or fully formed of magnesium, magnesium alloy, aluminum, aluminum alloy, or polymeric materials.

In another and/or alternative non-limiting aspect of the invention, there is provided a degradable high-strength zinc alloy that has high strength, controlled degradation, and high hardness.

In another and/or alternative non-limiting aspect of the invention, there is provided a degradable high-strength zinc alloy that can be manufactured by a method that is low cost, scalable, and results in the formation of a degradable high-strength zinc alloy having a controlled corrosion rate, and which degradable high-strength zinc alloy has a similar or increased strength as compared to traditional engineering alloys such as aluminum, magnesium, and iron, and the degradable high-strength zinc alloy has a hardness that is greater than malleable cast iron (e.g., a hardness greater than 130 [Brinell scale]). In one non-limiting embodiment, the hardness of the degradable high-strength zinc alloy is greater than 170 Brinell scale. In another non-limiting embodiment, the hardness of the degradable high-strength zinc alloy is greater than 260 Brinell scale. In another non-limiting embodiment, the hardness of the degradable high-strength zinc alloy is greater than 310 Brinell scale.

In another and/or alternative non-limiting aspect of the invention, there is provided a degradable high-strength zinc alloy that can be manufactured wherein traditional heat treatments, deformation processing, and machining techniques can be used without impacting the dissolution rate and reliability of components that are partially or fully formed by the degradable high-strength zinc alloy.

In another and/or alternative non-limiting aspect of the invention, there is provided a degradable high-strength zinc alloy wherein multicomponent alloying additives are added to the zinc alloy to control and engineer the degradation rate of the degradable high-strength zinc alloy.

In another and/or alternative non-limiting aspect of the invention, there is provided a degradable high-strength zinc alloy that 1) has high hardness, 2) has high resistance to wear, 3) has high resistance to deformation, 4) is erosion resistant, and 5) exhibits controlled degradation rates in aqueous media of temperatures 35-200+° C.

In another and/or alternative non-limiting aspect of the invention, there is provided a degradable high-strength zinc alloy that has a degradation/corrosion rate in fresh and salt water of 0.1-75 mm/day (and all values and ranges therebetween) at 30-180° C. (and all values and ranges therebetween). In one non-limiting embodiment, the degradable high-strength zinc alloy has a degradation/corrosion rate in fresh and salt water of 0.1-75 mm/day at 50-135° C. In another non-limiting embodiment, the degradable high-strength zinc alloy has a degradation/corrosion rate in fresh and salt water of 1-50 mm/day at 50-135° C. in 3 wt. % KCl. In another non-limiting embodiment, the degradable high-strength zinc alloy has a degradation/corrosion rate in 3% KCl at 90° C. of 10-150 mg/cm$^2$/hr. (and all values and ranges therebetween). In another non-limiting embodiment, the degradable high-strength zinc alloy has a degradation/corrosion rate in 3% KCl at 90° C. of 10-90 mg/cm$^2$/hr. (and all values and ranges therebetween). In another non-limiting embodiment, the degradable high-strength zinc alloy has a degradation/corrosion rate in 3% KCl at 90° C. of 15-60 mg/cm$^2$/hr. (and all values and ranges therebetween). In another non-limiting embodiment, the degradable high-strength zinc alloy has a degradation/corrosion rate in 3% KCl at 90° C. of 20-40 mg/cm$^2$/hr. (and all values and ranges therebetween).

In another and/or alternative non-limiting aspect of the invention, there is provided a degradable high-strength zinc alloy that has a degradation/corrosion rate in fresh and salt water of less than 2 mg/cm$^2$/hr. at a temperature of 20° C. or less. In one non-limiting embodiment, the degradable high-strength zinc alloy has a degradation/corrosion rate in fresh and salt water of 0.001-2 mg/cm$^2$/hr. (and all values and ranges therebetween) at a temperature of 20° C. In another non-limiting embodiment, the degradable high-strength zinc alloy has a degradation/corrosion rate in fresh and salt water of 0.001-1 mg/cm$^2$/hr. at a temperature of 20° C.

In another and/or alternative non-limiting aspect of the invention, there is provided a degradable high-strength zinc alloy that has a shear strength above 30 KSI, typically at least 32 KSI, and more typically at least 36 KSI.

In another and/or alternative non-limiting aspect of the invention, there is provided a degradable high-strength zinc alloy that has a tensile strength that is greater than 30 KSI, typically at least 50 KSI, more typically at least 60, and still more typically at least 80 KSI.

In another and/or alternative non-limiting aspect of the invention, there is provided a degradable high-strength zinc alloy that is formed from either 1) blended, prealloyed (including mechanically alloyed and melt atomized) powders wherein the zinc constitutes over 50 wt. % of the degradable high-strength zinc alloy, or 2) a melt, in which alloying additives are added to a molten solution of zinc, where the zinc is over 50% of the degradable high-strength zinc alloy, and may be prealloyed, such as starting with common ZA27, ZA12, EZAC, Zn—Li, or other zinc prealloy.

In another and/or alternative non-limiting aspect of the invention, there is provided a degradable high-strength zinc alloy that includes additives of 1) at least one more electropositive metals, and 2) one or more electronegative additives. In one non-limiting embodiment, the additives can form a solid solution or intermetallic particles and can then form intermetallics and precipitates in the degradable high-strength zinc alloy upon cooling and/or heat treatment of the high-strength zinc alloy.

In another and/or alternative non-limiting aspect of the invention, there is provided a degradable high-strength zinc alloy that includes one or more electropositive elements (i.e., electronegatively of less than 1.65). In one non-limiting embodiment, the one or more electropositive elements that can be included in the degradable high-strength zinc alloy include aluminum, magnesium, calcium, lithium, sodium, strontium, cesium, potassium, barium, scandium, Rare Earth (RE), and/or yttrium. In another non-limiting embodiment, the degradable high-strength zinc alloy includes one electropositive element. In another non-limiting embodiment, the degradable high-strength zinc alloy includes two or more electropositive elements. In another non-limiting embodiment, the content of the one or more electropositive elements that are included in the degradable high-strength zinc alloy is at least 2 wt. %. In another non-limiting embodiment, the content of the one or more electropositive elements that are included in the degradable high-strength zinc alloy is at least 5 wt. %. In another non-limiting embodiment, the content of the one or more electropositive elements that are included in the degradable high-strength zinc alloy is about 2-50 wt. % (and all values and ranges therebetween). In another non-limiting embodiment, the content of the one or more electropositive elements that are included in the degradable high-strength zinc alloy is about 5-35 wt. %. In another non-limiting embodiment, the content of the one or more electropositive elements that are included in the degradable high-strength zinc alloy is about 5-25 wt. %. In another non-limiting embodiment, the content of the one or more electropositive elements that are included in the degradable high-strength zinc alloy is about 5-15 wt. %.

In another and/or alternative non-limiting aspect of the invention, there is provided a degradable high-strength zinc alloy that includes one or more electronegative elements (i.e., electronegatively of greater than 1.8). In one non-limiting embodiment, the one or more electronegative elements that can be included in the degradable high-strength zinc alloy include iron, gallium, indium, tin, lead, bismuth, germanium, strontium, nickel, copper, cobalt, iron, mercury, silver, molybdenum, indium, antimony, silicon, boron, and/or carbon. In another non-limiting embodiment, the degradable high-strength zinc alloy includes one electronegative element. In another non-limiting embodiment, the degradable high-strength zinc alloy includes two or more electronegative elements. In another non-limiting embodiment, the content of the one or more electronegative elements that are included in the degradable high-strength zinc alloy is at least 0.1 wt. %. In another non-limiting embodiment, the content of the one or more electronegative elements that are included in the degradable high-strength zinc alloy is at least 0.5 wt. %. In another non-limiting embodiment, the content of the one or more electronegative elements that are included in the degradable high-strength zinc alloy is about 0.1-20 wt. % (and all values and ranges therebetween). In another non-limiting embodiment, the content of the one or more electropositive elements that are included in the degradable high-strength zinc alloy is about 0.5-15 wt. %.

In another and/or alternative non-limiting aspect of the invention, there is provided a degradable high-strength zinc alloy that includes both one or more electropositive elements and one or more electronegative elements. In one non-limiting embodiment, the total weight percent of the electropositive elements in the degradable high-strength zinc alloy is greater than the total weight percent of the electronegative elements in the degradable high-strength zinc alloy.

In another and/or alternative non-limiting aspect of the invention, there is provided a degradable high-strength zinc alloy that includes greater than 50 wt. % zinc, and one or more elements selected from the group consisting of calcium, aluminum, copper, lead, tin, magnesium, and gallium. In one non-limiting embodiment, the degradable high-strength zinc alloy includes 51-80 wt. % zinc (and all values and ranges therebetween). In another non-limiting embodiment, the degradable high-strength zinc alloy includes 55-75 wt. % zinc. In another non-limiting embodiment, the degradable high-strength zinc alloy includes 60-73 wt. % zinc. When calcium is included in the degradable high-strength zinc alloy, the calcium content in the degradable high-strength zinc alloy is 0.5-15 wt. % (and all values and ranges therebetween), typically 1-15 wt. %, more typically 2-10 wt. %, and even more typically 5-10 wt. %. When aluminum is included in the degradable high-strength zinc alloy, the aluminum content in the degradable high-strength zinc alloy is 2-40 wt. % (and all values and ranges therebetween), typically 5-35 wt. %, and more typically 10-30 wt. %. When copper is included in the degradable high-strength zinc alloy, the copper content in the degradable high-strength zinc alloy is 0.1-8 wt. % (and all values and ranges therebetween), typically 0.5-5 wt. %, and more typically 1-4 wt. %. When lead is included in the degradable high-strength zinc alloy, the lead content in the degradable high-strength zinc alloy is 0.001-5 wt. % (and all values and ranges therebetween), typically 0.002-2 wt. %, and more typically 0.005-0.5 wt. %. When tin is included in the degradable high-strength zinc alloy, the tin content in the degradable high-strength zinc alloy is 0.05-7 wt. % (and all values and ranges therebetween), typically 0.1-5 wt. %, and more typically 0.5-3 wt. %. When magnesium is included in the degradable high-strength zinc alloy, the magnesium content in the degradable high-strength zinc alloy is 0.1-45 wt. % (and all values and ranges therebetween), typically 1-35 wt. %, more typically 5-25 wt. %. When gallium is included in the degradable high-strength zinc alloy, the gallium content in the degradable high-strength zinc alloy is 0.05-7 wt. % (and all values and ranges therebetween), typically 0.1-5 wt. %, and more typically 0.5-3 wt. %.

In another and/or alternative non-limiting aspect of the invention, there is provided a degradable high-strength zinc alloy that includes greater than 50 wt. % zinc, 0.5-15 wt. % calcium, and optionally one or more elements selected from the group consisting of aluminum, copper, lead, tin, magnesium, zinc and gallium.

In another and/or alternative non-limiting aspect of the invention, there is provided a degradable high-strength zinc alloy that includes greater than 50 wt. % zinc, 0.5-15 wt. % calcium, 2-40 wt. % aluminum, and optionally one or more elements selected from the group consisting of copper, lead, tin, magnesium, zinc and gallium.

In another and/or alternative non-limiting aspect of the invention, there is provided a degradable high-strength zinc alloy that includes greater than 50 wt. % zinc, 0.5-15 wt. % calcium, 2-40 wt. % aluminum, and two or more elements selected from the group consisting of copper, lead, tin, magnesium, zinc and gallium. In one non-limiting embodiment, the aluminum content is greater than the content of calcium in the degradable high-strength zinc alloy. In another non-limiting embodiment, the aluminum content in the degradable high-strength zinc alloy is the second highest weight percent component of the degradable high-strength zinc alloy, and the calcium content in the degradable high-strength zinc alloy is the third highest weight percent component of the degradable high-strength zinc alloy.

In another and/or alternative non-limiting aspect of the invention, there is provided a degradable high-strength zinc alloy that includes 20-70 wt. % zinc (and all values and ranges therebetween) and 30-80 wt. % magnesium (and all values and ranges therebetween), and optionally one or more elements selected from the group consisting of calcium, aluminum, copper, lead, tin, and gallium. In one non-limiting embodiment, the zinc content of the degradable high-strength zinc alloy is 20-60 wt. %. In another non-limiting embodiment, the zinc content of the degradable high-strength zinc alloy is 20-50 wt. %. In another non-limiting embodiment, the zinc content of the degradable high-strength zinc alloy is 20-40 wt. %. In another non-limiting embodiment, the magnesium content of the degradable high-strength zinc alloy is 30-65 wt. %. In another non-limiting embodiment, the magnesium content of the degradable high-strength zinc alloy is 40-65 wt. %. In another non-limiting embodiment, the magnesium content of the degradable high-strength zinc alloy is 50-65 wt. %. In another non-limiting embodiment, the magnesium content of the degradable high-strength zinc alloy is 55-60 wt. %.

In another and/or alternative non-limiting aspect of the invention, there is provided a degradable high-strength zinc alloy that can include one or more materials to increase the hardness and wear resistance of the degradable high-strength zinc alloy. In one non-limiting embodiment, the one or more materials that can be used in the degradable high-strength zinc alloy to increase the hardness and wear resistance of the degradable high-strength zinc alloy includes SiC, $Al_2O_3$, $B_4C$, $ZrO_2$, TiC, TiN, iron, steel, and/or other hard particles.

In another non-limiting embodiment, the content of the one or more materials that can be used in the degradable high-strength zinc alloy to increase the hardness and wear resistance of the degradable high-strength zinc alloy is at least 0.1 wt. %, and typically about 0.1-20 wt. % (and all values and ranges therebetween).

In another and/or alternative non-limiting aspect of the invention, there is provided a degradable high-strength zinc alloy can include one or more low density materials to reduce the density of the high-strength zinc alloy. In one non-limiting embodiment, the one or more low density materials that can be used to reduce the density of the degradable high-strength zinc alloy have a density of no more than 1 g/cm$^3$. In one non-limiting embodiment, the low density material has a density of about 0.1-0.9 g/cm$^3$ Non-limiting examples of low density materials that can be used to reduce the density of the degradable high-strength zinc alloy include hollow microballoons such as, but not limited to, hollow microballoons made of glass, carbon, and/or ceramic (such as cenospheres). In another non-limiting embodiment, the one or more low density materials that can be used to reduce the density of the degradable high-strength zinc alloy constitutes at least 0.1 wt. % of the degradable high-strength zinc alloy (and all values and ranges therebetween). In another non-limiting embodiment, the one or more low density materials that can be used to reduce the density of the degradable high-strength zinc alloy constitutes 0.1-15 wt. % of the degradable high-strength zinc alloy (and all values and ranges therebetween).

In another and/or alternative non-limiting aspect of the invention, there is provided a degradable high-strength zinc alloy that can include ceramic particles. The addition of ceramic particles can result in a reduction of the corrosion rates of the degradable high-strength zinc alloy. The reduction in corrosion rate can be offset by adding additional active dopants or additives (increasing the phase content of galvanically-active higher and lower electronegativity) compounds.

In another and/or alternative non-limiting aspect of the invention, there is provided a degradable high-strength zinc alloy that includes more than 35 wt. % zinc, and wherein the degradable high-strength zinc alloy has a degradation rate of about 0.01-30 mm/day in a 3 wt. % KCl solution at a temperature of 90° C., and wherein the degradable high-strength zinc alloy has a shear strength of greater than 20,000 psig.

In another and/or alternative non-limiting aspect of the invention, there is provided a degradable high-strength zinc alloy that includes more than 35 wt. % zinc, and wherein the degradable high-strength zinc alloy has a degradation rate of about 0.01-30 mm/day in a 3 wt. % KCl solution at a temperature of 90° C., and wherein the degradable high-strength zinc alloy has a hardness of greater than 80 Rockwell B.

In another and/or alternative non-limiting aspect of the invention, there is provided a degradable high-strength zinc alloy that is formed by melting or partially melting the components of the degradable high-strength zinc alloy, and then filling or casting the degradable high-strength zinc alloy into a mold using any combination of low pressure die casting, high pressure die casting, squeeze casting or pressure assisted casting.

One non-limiting objective of the present invention is the provision of a degradable high-strength zinc alloy for use in producing degradable tools and components.

Another and/or alternative objective of the present invention is the provision of a degradable high-strength zinc alloy suitable for use in producing degradable tools and components for use in the field of oilfield exploration, production, and testing.

Another and/or alternative objective of the present invention is the provision of a degradable high-strength zinc alloy suitable for use in manufacturing degradable, high-strength compositions, and their application in oil and gas and related application fields.

Another and/or alternative objective of the present invention is the provision of a degradable high-strength zinc alloy that is formed by the galvanic activation of zinc alloys.

Another and/or alternative objective of the present invention is the provision of a degradable high-strength zinc alloy made degradable in a controlled fashion through the alloying of both electropositive and electronegative alloying additives.

Another and/or alternative objective of the present invention is the provision of a degradable high-strength zinc alloy that includes 1) one or more electropositive alloying additives and 2) one or more electronegative galvanic activators.

Another and/or alternative objective of the present invention is the provision of a degradable high-strength zinc alloy that includes one or more electropositive additives (e.g., element having an electronegativity that is less than 1.65 [e.g., aluminum, magnesium, calcium, lithium, sodium, strontium, cesium, potassium, barium, scandium, Rare Earth (RE), and/or yttrium]), and one or more electronegative additives (e.g., element having an electronegativity that is greater than 1.75 [e.g., iron, gallium, indium, tin, lead, bismuth, germanium, strontium, nickel, copper, cobalt, iron, mercury, silver, molybdenum, indium, antimony, silicon, boron, and/or carbon]).

Another and/or alternative objective of the present invention is the provision of a degradable high-strength zinc alloy that includes an electropositive metal selected from elements that can have an electronegativity of less than 1.3, along with a galvanically-activating additive with an electronegativity of greater than 1.75. Examples of one or more electropositive metals that can be included in the degradable high-strength zinc alloy are lithium, strontium, calcium, sodium, strontium, cesium, potassium, and/or yttrium. Examples of one or more electronegative additives that can be included in the degradable high-strength zinc alloy are gallium, indium, tin, lead, bismuth, nickel, copper, cobalt, iron, mercury, silver, molybdenum, silicon, boron, and/or carbon.

Another and/or alternative objective of the present invention is the provision of a degradable high-strength zinc alloy wherein elemental zinc or a zinc alloy is alloyed with one or more of magnesium, aluminum, and/or lithium to form a high-strength refined structure that is more electropositive than elemental zinc alone, and wherein the degradable high-strength zinc alloy is further alloyed with one or more of calcium, lithium, strontium, an/or sodium, and the degradable high-strength zinc alloy is optionally further alloyed with a galvanic dopant or an additive from of one or more of gallium, indium, nickel, copper, tin, lead, iron, bismuth, antimony, and/or mercury. The alloying additives to the degradable high-strength zinc alloy can be in the form of an elemental metal and/or via a metallic alloy that includes one or more of the alloying additives. As defined herein, an elemental metal is a metal having a purity of at least 99.5% and up to 0.5 wt. % impurities. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with one or more of magnesium, aluminum, and/or lithium to form a high-strength refined structure that is more electropositive than elemental zinc alone, and wherein the degradable high-strength zinc alloy is further alloyed with one or more of calcium, lithium, strontium, and/or sodium, and the degradable high-strength zinc alloy is optionally further alloyed with a galvanic dopant or an additive from of one or more of gallium, indium, nickel, copper, tin, lead, iron, bismuth, antimony, and/or mercury, and wherein the zinc content of the degradable high-strength zinc alloy is 55-98 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with one or more of magnesium, aluminum, and/or lithium to form a high-strength refined structure that is more electropositive than elemental zinc alone, and wherein the degradable high-strength zinc alloy is further alloyed with one or more of calcium, lithium, strontium, and/or sodium, and the degradable high-strength zinc alloy is further alloyed with a galvanic dopant or an additive from of two or more of gallium, indium, nickel, copper, tin, lead, iron, bismuth, antimony, and/or mercury, and wherein the zinc content of the degradable high-strength zinc alloy is 55-98 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with one or two of magnesium, aluminum, and/or lithium to form a high-strength refined structure that is more electropositive than elemental zinc alone, and wherein the degradable high-strength zinc alloy is further alloyed with one or two of calcium, lithium, strontium, and/or sodium, and the degradable high-strength zinc alloy is further alloyed with a galvanic dopant or an additive from two or more of gallium, indium, nickel, copper, tin, lead, iron, bismuth, antimony, and/or mercury, and wherein the zinc content of the degradable high-strength zinc alloy is 55-98 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with one of magnesium, aluminum, and/or lithium to form a high-strength refined structure that is more electropositive than elemental zinc alone, and wherein the degradable high-strength zinc alloy is further alloyed with one of calcium, lithium, strontium, and/or sodium, and the degradable high-strength zinc alloy is further alloyed with a galvanic dopant or an additive from two or more of gallium, indium, nickel, copper, tin, lead, iron, bismuth, antimony, and/or mercury and wherein the zinc content of the degradable high-strength zinc alloy is 55-98 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with 5-35 wt. % (and all values and ranges therebetween) of one or more of magnesium, aluminum, and/or lithium to form a high-strength refined structure that is more electropositive than elemental zinc alone, and wherein the degradable high-strength zinc alloy is further alloyed with 1-20 wt. % (and all values and ranges therebetween) of one or more of calcium, lithium, strontium, and/or sodium, and the degradable high-strength zinc alloy is further alloyed with 1-20 wt. % (and all values and ranges therebetween) of a galvanic dopant or an additive from one or more of gallium, indium, nickel, copper, tin, lead, iron, bismuth, antimony, and/or mercury, and wherein the zinc content of the degradable high-strength zinc alloy is 55-93 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zemak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with 10-35 wt. % (and all values and ranges therebetween) of one or more of magnesium, aluminum, and/or lithium to form a high-strength refined structure that is more electropositive than elemental zinc alone, and wherein the degradable high-strength zinc alloy is further alloyed with 2-15 wt. % (and all values and ranges therebetween) of one or more of calcium, lithium, strontium, and/or sodium, and the degradable high-strength zinc alloy is further alloyed with 2-15 wt. % (and all values and ranges therebetween) of a galvanic dopant or an additive from one or more of gallium, indium, nickel, copper, tin, lead, iron, bismuth, antimony, and/or mercury, and wherein the zinc content of the degradable high-strength zinc alloy is 55-86 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with 12-30 wt. % (and all values and ranges therebetween) magnesium, aluminum and/or lithium to form a metallic alloy having a high-strength refined structure that is more electropositive than elemental zinc alone, and wherein the degradable high-strength zinc alloy is further alloyed with 4-10 wt. % (and all values and ranges therebetween) of one or more of calcium, lithium, strontium, and/or sodium, and the degradable high-strength zinc alloy is further alloyed with 3-10 wt. % (and all values and ranges therebetween) of a galvanic dopant or an additive form of one or more of gallium, indium, nickel, copper, tin, lead, iron, bismuth, antimony, and/or mercury, and wherein the zinc content is 60-81 wt. % (and all values and ranges therebetween) of the degradable high-strength zinc alloy. The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with aluminum to form a high-strength refined structure that is more electropositive than elemental zinc alone, and wherein the degradable high-strength zinc alloy is further alloyed with elemental calcium, and the degradable high-strength zinc alloy is further alloyed with a galvanic dopant or an additive from two or more of gallium, copper, tin, and/or lead, and wherein the zinc content of the degradable high-strength zinc alloy is 55-98 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with 10-18 wt. % (and all values and ranges therebetween) of aluminum to form a high-strength refined structure that is more electropositive than elemental zinc alone, and wherein the degradable high-strength zinc alloy is further alloyed with 4-10 wt. % (and all values and ranges therebetween) of calcium, and the degradable high-strength zinc alloy is further alloyed with 3-10 wt. % (and all values and ranges therebetween) of a galvanic dopant or an additive from two or more of gallium, copper, tin, and/or lead, and wherein the zinc content of the degradable high-strength zinc alloy is 65-83 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy wherein elemental zinc or a zinc alloy is alloyed with 22-32 wt. % (and all values and ranges therebetween) of aluminum to form a high-strength refined structure that is more electropositive than elemental zinc alone, and wherein the degradable high-strength zinc alloy is further alloyed with 4-10 wt. % (and all values and ranges therebetween) of calcium, and the degradable high-strength zinc alloy is further alloyed with 3-10 wt. % (and all values and ranges therebetween) of a galvanic dopant or an additive from two or more of gallium, copper, tin, and/or lead, and wherein the zinc content of the degradable high-strength zinc alloy is 55-71 wt. % of the zinc alloy (and all values and ranges therebetween). The alloying additives to the zinc can be in the form of an elemental metal and/or via a metallic alloy that includes one or more of the alloying additives. The source of zinc in the degradable high-strength zinc alloy can be elemental zinc and/or an alloy of zinc (e.g., Zamak, Zn—Li, Zn—Mg, Zn—Al (ZA), ZA27, ZA12, EZAC, Zn—Li, or other zinc prealloy). The degradable high-strength zinc alloy can be formed by 1) a cast process wherein the zinc or zinc alloy is heated above its melting point and one or more of the metal additives are added to the zinc or zinc alloy at a temperature that is above or below the melting point of the metal additives, or 2) powders of the metals used to form the degradable high-strength zinc alloy are sintered together to form the degradable high-strength zinc alloy. After the degradable high-strength zinc alloy is formed, the degradable high-strength zinc alloy can be extruded, heat treated, or otherwise post processed.

Another and/or alternative objective of the present invention is the provision of a degradable high-strength zinc alloy that includes zinc, magnesium and calcium, and wherein the total combined content of zinc, magnesium and calcium in the degradable high-strength zinc alloy is 90-100 wt. %.

Another and/or alternative objective of the present invention is the provision of a degradable high-strength zinc alloy that includes zinc, magnesium and calcium, and wherein the total combined content of zinc, magnesium and calcium in the degradable high-strength zinc alloy is 90-100 wt. %, and wherein the zinc content is greater than 50% of the degradable high-strength zinc alloy.

Another and/or alternative objective of the present invention is the provision of a degradable high-strength zinc alloy that includes zinc, aluminum, copper, tin, calcium and gallium, and wherein the total combined content of zinc, aluminum, copper, tin, lead, calcium and gallium in the degradable high-strength zinc alloy is 90-100 wt. %.

Another and/or alternative objective of the present invention is the provision of a degradable high-strength zinc alloy that includes zinc, aluminum, copper, tin, calcium and gallium, and wherein the total combined content of zinc, aluminum, copper, tin, lead, calcium and gallium in the degradable high-strength zinc alloy is 90-100 wt. %, and wherein the zinc content is greater than 50% of the degradable high-strength zinc alloy.

Another and/or alternative objective of the present invention is the provision of a degradable high-strength zinc alloy that includes zinc, aluminum, copper, tin, lead, calcium and gallium, and wherein the total combined content of zinc, aluminum, copper, tin, lead, calcium and gallium in the degradable high-strength zinc alloy is 90-100 wt. %.

Another and/or alternative objective of the present invention is the provision of a degradable high-strength zinc alloy that includes zinc, aluminum, copper, tin, lead, calcium and gallium, and wherein the total combined content of zinc, aluminum, copper, tin, lead, calcium and gallium in the degradable high-strength zinc alloy is 90-100 wt. %, and wherein the zinc content is greater than 50% of the degradable high-strength zinc alloy.

Another and/or alternative objective of the present invention is the provision of a degradable high-strength zinc alloy that includes zinc, aluminum, and copper, and wherein the total combined content of zinc, aluminum, and copper in the degradable high-strength zinc alloy is 90-100 wt. %.

Another and/or alternative objective of the present invention is the provision of a degradable high-strength zinc alloy that includes zinc, aluminum, and copper, and wherein the total combined content of zinc, aluminum, and copper in the degradable high-strength zinc alloy is 90-100 wt. %, and wherein the zinc content is greater than 50% of the degradable high-strength zinc alloy.

Another and/or alternative objective of the present invention is the provision of a degradable high-strength zinc alloy that includes zinc, aluminum, magnesium, and copper, and wherein the total combined content of zinc, aluminum, magnesium, and copper in the degradable high-strength zinc alloy is 90-100 wt. %.

Another and/or alternative objective of the present invention is the provision of a degradable high-strength zinc alloy includes zinc, aluminum, magnesium, and copper, and wherein the total combined content of zinc, aluminum, magnesium, and copper in the degradable high-strength zinc alloy is 90-100 wt. %, and wherein the zinc content is greater than 50% of the degradable high-strength zinc alloy.

Another and/or alternative objective of the present invention is the provision of a completion device that is partially or fully formed of a degradable high-strength zinc alloy.

Another and/or alternative objective of the present invention is the provision of a completion device that is partially or fully formed of a degradable high-strength zinc alloy that has a greater strength than completion devices that are partially or fully formed of magnesium, magnesium alloy, aluminum, aluminum alloy, or polymeric materials.

Another and/or alternative objective of the present invention is the provision of a degradable high-strength zinc alloy that has high strength, controlled degradation, and high hardness.

Another and/or alternative objective of the present invention is the provision of a degradable high-strength zinc alloy that can be manufactured by a method that is low cost, scalable, and results in the formation of a degradable high-strength zinc alloy having a controlled corrosion rate, and which degradable high-strength zinc alloy has a similar or increased strength as compared to traditional engineering alloys such as aluminum, magnesium, and iron, and the degradable high-strength zinc alloy has a hardness that is higher than cast iron.

Another and/or alternative objective of the present invention is the provision of a degradable high-strength zinc alloy that can be manufactured wherein traditional heat treatments, deformation processing, and machining techniques can be used without impacting the dissolution rate and reliability of components that are partially or fully formed by the degradable high-strength zinc alloy.

Another and/or alternative objective of the present invention is the provision of a degradable high-strength zinc alloy that includes multicomponent alloying additives to control and engineer the degradation rate of the degradable high-strength zinc alloy.

Another and/or alternative objective of the present invention is the provision of a degradable high-strength zinc alloy that 1) has high hardness, 2) has high resistance to wear, 3) has high resistance to deformation, 4) is erosion resistant, and 5) exhibits controlled degradation rates in aqueous media of temperatures over 35-200° C.

Another and/or alternative objective of the present invention is the provision of a degradable high-strength zinc alloy that has a degradation/corrosion rate in fresh and salt water of 0.1-75 mm/day at 30-180° C., and generally at 50-135° C.

Another and/or alternative objective of the present invention is the provision of a degradable high-strength zinc alloy that has a shear strength above 30 KSI, typically at least 32 KSI, and more typically at least 36 KSI.

Another and/or alternative objective of the present invention is the provision of a degradable high-strength zinc alloy that has a tensile strength that is greater than 30 KSI, typically at least 50 KSI, and more typically at least 70-80 KSI.

Another and/or alternative objective of the present invention is the provision of a degradable high-strength zinc alloy that is formed from either 1) blended, prealloyed (including mechanically alloyed and melt atomized) powders, or 2) from a melt, in which alloying additives are added to a molten solution of zinc, where the zinc is over 50% of the melt.

Another and/or alternative objective of the present invention is the provision of a degradable high-strength zinc alloy that includes additions of 1) one or more electropositive metals, and 2) one or more electronegative additives.

Another and/or alternative objective of the present invention is the provision of a degradable high-strength zinc alloy that can include one or more materials to increase the hardness and wear resistance of the degradable high-strength zinc alloy such as ceramic or hard metallic particles.

Another and/or alternative objective of the present invention is the provision of a degradable high-strength zinc alloy that can include one or more materials to reduce the density of the degradable high-strength zinc alloy such as, but not limited to, hollow microballoons.

Another and/or alternative objective of the present invention is the provision of a degradable high-strength zinc alloy that can include ceramic particles.

Another and/or alternative objective of the present invention is the provision of a degradable high-strength zinc alloy which includes more than 50 wt. % zinc, which degrades at a rate of 0.01-30 mm/day in a fluid at at least 90° C., and which has a shear strength exceeding 25,000 psig.

Another and/or alternative objective of the present invention is the provision of a degradable high-strength zinc alloy which includes greater than 5 wt. % of one or more elements selected from aluminum, magnesium, calcium, lithium, sodium, and/or strontium.

Another and/or alternative objective of the present invention is the provision of a degradable high-strength zinc alloy that includes one or more electronegative alloying additives of 0.5-15 wt. % of one or more elements having an electronegativity greater than 1.75.

Another and/or alternative objective of the present invention is the provision of a degradable high-strength zinc alloy that includes one or more electronegative alloying additive that are added in a sufficient amount and/or in a form to create a second phase in the degradable high-strength zinc alloy, wherein the second phase is a metal, compound, and/or intermetallic.

Another and/or alternative objective of the present invention is the provision of a degradable high-strength zinc alloy that is formed from high-strength Zamak (i.e., base metal of zinc and alloying additives of aluminum, magnesium, and copper), Zn—Li, Zn—Mg, Zn—Al (ZA) or some other zinc alloy (e.g., ZA27, ZA12, EZAC, etc.) which has been modified to accelerate degradability of the degradable high-strength zinc alloy, and wherein such modification includes the addition of 0.5-15 wt. % at least one electropositive additive that has an electronegativity less than 1.35, and at least one electronegative alloying additive with an electronegativity greater than 1.75.

Another and/or alternative objective of the present invention is the provision of a degradable high-strength zinc alloy that is fabricated using a powder metallurgy process.

Another and/or alternative objective of the present invention is the provision of a degradable high-strength zinc alloy that is formed by adding alloying or particle additives to a molten zinc or zinc alloy.

Another and/or alternative objective of the present invention is the provision of a degradable high-strength zinc alloy that is formed by melting all of the components at a temperature and for a time suitable to form a homogeneous liquid, and then cooling and solidifying the melt to create a multiphase solid.

Another and/or alternative objective of the present invention is the provision of a degradable high-strength zinc alloy that is a multiphase solid that includes at least one phase containing an element more electronegative than zinc, and which phase is a metal, intermetallic, or compound, which is formed as a eutectic structure or precipitate.

Another and/or alternative objective of the present invention is the provision of a degradable high-strength zinc alloy that is used to form a component that is then further modified while maintaining the degradability of the degradable high-strength zinc alloy, and wherein such modification includes one or more process such as heat treatment, extrusion, forging, or other process to increase mechanical properties and/or alter the size, amount, and distribution of second phases and/or grain sizes.

Another and/or alternative objective of the present invention is the provision of a degradable high-strength zinc alloy that includes an insoluble second phase to alter the physical or mechanical properties of the degradable high-strength zinc alloy such as hardness, density/buoyancy, tensile strength, shear strength, or compressive strength.

Another and/or alternative objective of the present invention is the provision of a degradable high-strength zinc alloy that is fabricated into a component or tool useful for oil and gas operations, such as a ball, plug, mandrel, slip, grip, button, flow diverter device, sleeve, dart, rod, wire, strip.

Another and/or alternative objective of the present invention is the provision of a component or tool that is partially or fully formed of a degradable high-strength zinc alloy, and wherein the component or tool is degraded through the processes of 1) placing the component or tool into a wellbore; 2) allowing the component or tool to contact a wellbore fluid; and 3) allowing the component or tool to degrade in fresh water or the wellbore fluid.

Another and/or alternative objective of the present invention is the provision of a degradable high-strength zinc alloy that has a shear strength of at least 35,000 psi.

Another and/or alternative objective of the present invention is the provision of a degradable high-strength zinc alloy that has a tensile ultimate strength of at least 50 KSI.

Other objects, advantages, and novel features of the present invention will become apparent from the following detailed description of the invention when considered in conjunction with the accompanying drawings.

BRIEF DESCRIPTION OF THE DRAWINGS

Reference may now be made to the drawings, which illustrate various non-limiting aspects of embodiments that the disclosure may take in physical form and in certain parts and arrangements of parts wherein:

FIG. 2 illustrates a degradable high-strength zinc alloy of $ZnAl_{14}Cu_2Sn_2Pb_2Ca_8Ga_1$ in accordance with the present invention after exposure to 3 wt. % KCl at 90° C. for 3.5 days;

FIG. 3*a* illustrates a degradable high-strength zinc alloy of $ZnAl_{27}Cu_2Sn_1Pb_1Ca_8Ga_1$ before exposure to 3 wt % KCl at 90° C. and FIG. 3*b* illustrates the degradable high-strength zinc alloy of $ZrAl_{27}Cu_2Sn_1Pb_1Ca_8Ga_1$ after exposure to 3 wt. % KCl at 90° C. for about 20.06 hours;

FIG. 4 illustrates the structure of a degradable high-strength zinc alloy in accordance with the present invention.

DETAILED DESCRIPTION OF THE INVENTION

Figure 1:
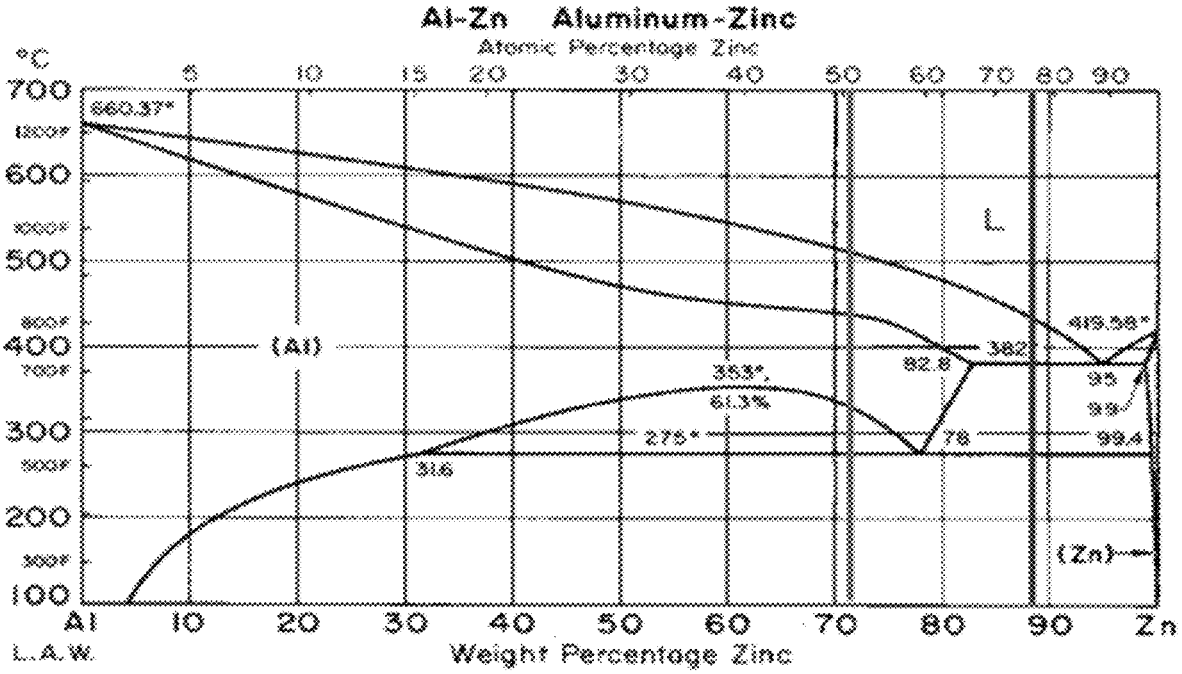
FIG. 1 illustrates an aluminum-zinc phase diagram.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

Referring now to the drawings, wherein the showings are for the purpose of illustrating non-limiting embodiments of the disclosure only and not for the purpose of limiting the same, the present invention is based on the galvanic activation of degradable high-strength zinc alloys. Zinc can be made degradable in a controlled fashion through the alloying of both electropositive and electronegative alloying additives. The degradable high-strength zinc alloy includes one or more electropositive additives (e.g., element having an electronegativity that is less than 1.65 [e.g., aluminum, magnesium, calcium, manganese, scandium, yttrium, Rare Earth (RE) and/or strontium]), and one or more electronegative additives (e.g., element having an electronegativity that is greater than 1.75 [e.g., iron, copper, cobalt, nickel, lead, bismuth, gallium, germanium, silver, mercury, indium, tin, and/or antimony]), and optionally includes a water-reactive metal (e.g., calcium, lithium, sodium, cesium, strontium, barium, and/or potassium).

The degradable high-strength zinc alloy can be formed from Zn—Al—Cu alloys, with optionally some magnesium additives.

For a corrodible degradable high-strength zinc alloy, the content of aluminum, calcium and/or magnesium in the degradable high-strength zinc alloy can be greater than 10 wt. %.

The zinc source of the degradable high-strength zinc alloy can be from pure zinc or from a zinc alloy such as Zamak, EZAC, and ZA (12 and 27) alloys, Zn—Li, Zn—Mg, Zn—Al (ZA), EZAC, Zn—Li, or other zinc prealloy.

The corrosion or degradation rates of the degradable high-strength zinc alloy can be increased by the addition of highly electropositive additives (e.g., elements having an electronegativity that is less than 1.35, and typically less than 1.2) in amounts of 0.5-10 wt. %. Such highly electropositive additives can also be used to reduce pH and salt/chloride content requirements of the degradable high-strength zinc alloy.

The degradable high-strength zinc alloy can be activated by the inclusion of a more electronegative additives such as gallium, indium, bismuth, tin, and/or lead being most effective additives, and nickel, copper, and iron being less or marginally effective.

To meet oilfield requirements, the degradable high-strength zinc alloy is able to dissolve within 60 days at 90° C. in 3 wt. % KCl, and typically at a rate of at least 1-10 mm/day at 30-135° C. in 500-50000 ppm chloride content aqueous fluids. In one non-limiting embodiment of the invention, the degradable high-strength zinc alloy has a dissolution rate in 3 wt. % KCl at 90° C. of at least 5 $mg/cm^2/hr$. In another non-limiting embodiment of the invention, the degradable high-strength zinc alloy has a dissolution rate in 3 wt. % KCl at 90° C. of 5-150 $mg/cm^2/hr$. (and all values and ranges therebetween). In another non-limiting embodiment of the invention, the degradable high-strength zinc alloy has a dissolution rate in 3 wt. % KCl at 90° C. of 10-80 $mg/cm^2/hr$. (and all values and ranges therebetween). In another non-limiting embodiment of the invention, the degradable high-strength zinc alloy has a dissolution rate in 3 wt. % KCl at 90° C. of 20-50 $mg/cm^2/hr$. (and all values and ranges therebetween). In another non-limiting embodiment of the invention, the degradable high-strength zinc alloy has a dissolution rate in 3 wt. % KCl at 90° C. of 25-40 $mg/cm^2/hr$. (and all values and ranges therebetween).

It was discovered that aluminum-zinc alloys based on $ZnAl_{14}Cu_2$ and $ZnAl_{27}Cu_2$ created successful degradable high-strength zinc alloy systems in accordance with the present invention. FIG. 1 illustrates an aluminum-zinc phase diagram. Desirable compositions for zinc-aluminum alloys are the aluminum, and aluminum and zinc phase fields, and typically to the aluminum-side of the eutectic (between red and blue lines). Some of the better zinc alloy compositions tested were found to lie in the 14-27 wt. % aluminum, or the alpha 1 aluminum or two phase field, on the aluminum side of the Zn—Al eutectic. These zinc alloys resulted in good dissolution rates with the addition of additional electropositive additives (alkali and alkaline Group 1 and 2) and electronegative additives (e.g., elements having an electronegativity greater than 1.75) metals. Given that the criteria for electronegativity of the element that is to be added to the zinc alloy should be less than magnesium, most of the rare earth elements plus yttrium should also activate on the electropositive side. The ability to catalyze $H_2$ formation (low $H_2$ over-potential, $H_2$ catalytic activity) is also desired. Low $H_2$ over-potential ($H_2$ catalytic activity) is normally seen in transition metals (e.g., nickel, copper, cobalt, iron) but is also present in metals that form Lewis acids and base oxides with water (e.g., bismuth, tin, indium, etc.). Zinc-lithium alloys also have high strength and can be used as the base alloy system to which an electronegative dopant or additive is added to the melt or as a solid additives. Galvanically-active additives include iron, cobalt, nickel, copper, gallium, indium, tin, lead, beryllium, carbon, boron, antimony, germanium, silicon, and silver in amounts that cause an electronegative phase (either the electronegative metal as in the tin, lead, gallium and indium systems) or intermetallic as in the antimony, bismuth, iron, cobalt, copper, and silver systems. Compounds with other electronegative additives other than zinc can also be used.

The method of addition of the additives to the zinc is to add the alloying additives to a melt or master alloy that is in the molten state, although addition in the semi-solid, or even solid (e.g., through mechanical blending or milling) can be equally effective.

Calcium and gallium additives below 2 wt. % alone in the ZnAlCu system were found to not promote the dissolution of the zinc alloy. If was found that the combination of CaSnGa with ZnAlCu alloys formed a degradable high-strength zinc alloy that had a good dissolution rate. A $ZnAl_{14}Cu_2Sn_2Pb_2Ca_8Ga_1$ system with and without lead additives was also found to have good mechanical and dissolution properties. A $ZnAl_2$ system with 8 wt. % calcium and 2 wt. % tin was also discovered to have a good dissolution rate. One such sample of the novel degradable high-strength zinc alloy of $ZnAl_{14}Cu_2Sn_2Pb_2Ca_8Ga_1$ in accordance with the present invention is illustrated in FIG. 2. FIG. 2 illustrates the condition of the novel degradable high-strength zinc alloy after exposure to 3 wt. % KCl at 90° C. for 3.5 days.

Also, it was found that $ZnAl_{27}Cu_2Sn_1Pb_1Ca_8Ga_1$ gave good continuous reaction and uniform dissolution during the testing without breaking a part.

FIG. 3 illustrates the degradable high-strength zinc alloy sample (Sample #37—$ZnAl_{27}Cu_2Sn_1Pb_1Ca_8Ga_1$) before and after testing. The degradable high-strength zinc alloy sample was tested in 3 wt. % KCl at 90° C. FIG. 3*a* illustrates the degradable high-strength zinc alloy sample prior to testing, and FIG. 3*b* illustrates the degradable high-strength zinc alloy sample after testing for 20.06 hrs. The degradable high-strength zinc alloy sample has initial dimensions of 15.87 mm diameter×24.87 mm length. Chart 1 illustrates the results of the dissolution rate of the degradable high-strength zinc alloy Sample #37 at 6 hrs., 12 hrs., and 20.06 hrs. of testing. During testing, the KCl solution was replaced with fresh KCl solution after each period of testing. The total testing time was 20.06 hrs. The final dimensions of the degradable high-strength zinc alloy sample after 20.06 hrs. of testing were 12.63 mm diameter× 21.47 mm length. The hardness of the cast and machined degradable high-strength zinc alloy sample prior to testing was 83.1 HRB based on an average hardness after 5 readings with a standard deviation of 5.74. The minimum hardness reading was 76.5 HRB and the maximum hardness reading was 89.5 HRB. The density of the degradable high-strength zinc alloy sample prior to testing was 4.2 $g/cm^3$.

CHART 1

| Time (hr.) | Dissolution Rate ($mg/cm^2/hr.$) at 90° C. | Weight Lost (grams) |
|---|---|---|
| 6 | 32.91 | −3.230 |
| +6 (12) | 35.96 | −3.270 |
| +8.06 (20.06) | 33.52 | −3.580 |

Compositions of the degradable high-strength zinc alloy can exist in a variety of morphologies (i.e., different physical forms on the atomic scale), including 1) an alloy of crystalline, amorphous or mixed crystalline and amorphous structure, and the features characterizing the composition (e.g., grains, phases, inclusions, and the like) may be of micron or submicron scale, for instance nanoscale; 2) powder metallurgy-like structures (e.g., pressed, compacted, sintered) including an inventive composition including at least one relatively reactive metal or alloy combined with an electronegative alloy or compound with the zinc alloy or compositions that preferentially develop large galvanic couples with the zinc alloy or elements in the non-intra-galvanic degradable alloy; or 3) composite and hybrid structures comprising one or more reactive metals or alloys as a metal matrix, imbedded with one or more relatively non-reactive materials of macro-to-nanoscopic sizes (e.g.

powders, particulates, platelets, flakes, fibers, compounds, and the like) or made for instance from stacks or layers of dissimilar metals, alloys and compositions with the provisos that certain layers are reactive.

The compositions of the degradable high-strength zinc alloy of the present invention are alloy compositions comprising an electropositive metal selected from elements that can have an electronegativity of less than 1.3, along with a galvanically-activating additive with an electronegativity of greater than 1.75. Examples of one or more electropositive metals that can be included in the degradable high-strength zinc alloy are lithium, calcium, sodium, cesium, potassium, and/or yttrium. Examples of one or more electronegative additives that can be included in the degradable high-strength zinc alloy are gallium, indium, tin, lead, bismuth, antimony, nickel, copper, cobalt, iron, mercury, silver, molybdenum, silicon, boron, and/or calcium.

The present invention pertains to a new class of zinc alloy compositions wherein zinc is made considerably more reactive than commercially available zinc and zinc alloys. To enhance the reactivity of the zinc, the zinc can be alloyed with magnesium, aluminum, and/or lithium to form a high-strength refined structure that is more electropositive than zinc alone. Furthermore, the zinc can be combined with calcium, lithium, strontium, and/or sodium, and a galvanic dopant or an additive such as gallium, indium, nickel, copper, tin, lead, iron, bismuth, antimony, and/or mercury.

For commercial applications, including oilfield applications, zinc is an attractive metal due to its worldwide availability, relatively low cost, high processability (e.g., zinc can be cast, welded, forged, extruded, machined, and the like), and nontoxicity (i.e., zinc and its alloys can be safely handled during fabrication, transportation, and final use of the degradable component).

Other inventive compositions are composite or hybrid structures, for instance made from those novel zinc alloys. A non-restrictive example of these innovative compositions is a metal-matrix composite of these degradable zinc alloys reinforced by ceramic particulates or fibers, itself coated with one or several other compositions, possibly metallic, ceramic, polymeric. A particularly useful option is to use steel wool or other iron fibrous or scaffold frameworks and infiltrate with the zinc alloy, where the iron wool, fiber, or scaffold acts as the galvanically-active component, as well as strengthening and hardening the zinc alloy.

The novel degradable high-strength zinc alloy of the present invention can be formed and/or processed into various shaped articles of manufacture. These articles can be solid parts as well as hollow parts or partially hollow parts. These articles can optionally include one or more coatings (polymer coatings, metal coatings, etc.) on all or a portion of the article. The one or more coatings (when used) can optionally vary on different surfaces on the article. A surface of the article can be optionally coated with one or multiple coating layers (e.g., generating a functionally graded composite composition). The novel degradable high-strength zinc alloy of the present invention can itself be used as a coating on a device that is formed of a material such as metal, plastic, and ceramic, etc. When the novel degradable high-strength zinc alloy of the present invention is used as a coating, the novel degradable high-strength zinc alloy of the present invention can be applied to the device by various processes (e.g., co-extrusion, adhesive bonding, dipping, among other processes).

Nanomaterials, either carbon-based (e.g. carbon nanotubes-single wall or multi-wall, buckyballs, nanofibers, nanoplatelets, and derivative versions of these) and/or non-carbon-based materials of all types of morphologies, may be used in the degradable high-strength zinc alloy to alter the strength and/or the reactivity of the degradable high-strength zinc alloy.

The novel degradable high-strength zinc alloy of the present invention can be used to partially or fully form a device, or be used as a coating on a device for various types of oilfield devices such as, but not limited to, balls, darts, and the like, useful for operating valves, serving as plugs, wellbore fluid diversion devices, and other wellbore treatment and production applications. The shape of the novel degradable high-strength zinc alloy of the present invention can also be used to contribute to the controllability of the degradation of the novel degradable high-strength zinc alloy. The novel degradable high-strength zinc alloy of the present invention can be used on certain applications wherein the partial degradation of the novel degradable high-strength zinc alloy causes a device to activate or deactivate, or become operable or inoperable.

The controllability of the reactivity and thus degradability of the novel degradable high-strength zinc alloy of the present invention when it completely forms or is partially used in certain devices may in some circumstances depend on the physical form or morphology of the degradable high-strength zinc alloy. The morphology of the degradable high-strength zinc alloy may be selected from pure metals, alloys purposely formulated to be 1) reactive (e.g., pressed, compacted, sintered), and/or 2) metallic-based composites and hybrid metallic compositions or combinations (e.g., a metal matrix embedded with relatively inert ingredients, metallic mesh compositions, coated metallic compositions, multilayered and functionally graded metallic compositions), wherein the degradable high-strength zinc alloy is formulated to a) degrade partially or totally, and/or b) degrade immediately or after a controlled and/or predictable time, wherein the degrading occurs when the degradable high-strength zinc alloy is exposed to a fluid (liquid and/or gaseous), wherein the fluid is either fully or partially i) aqueous (water and water-based fluids), ii) organic, iii) metallic (e.g. liquid metals), and/or iv) organometallic compounds of the formula RM, wherein R is a carbon (and in certain cases, silicon, or phosphorous) directly attached to a metal M.

Degradable high-strength zinc alloys that fall within the scope of the present invention include those that are highly sensitive to the presence of water, including water vapor, or humidity. Such fluid environments are corrosive (moderately to highly) to the degradable high-strength zinc alloy of the invention. The fluid used for disintegration of the degradable high-strength zinc alloy can be a well completion fluid (e.g., a brine or brackish water); however, freshwater down to 100 ppm chloride content can also be used. It has been observed that acidifying the fluid, such as by addition of acetic acid, can lower or alleviate the need for electropositive alloying additives while enabling dissolution of the degradable high-strength zinc alloy.

The degradable high-strength zinc alloy is formulated to be degradable, and can optionally be formulated to be categorized as biodegradable and safe or friendly to the environment when used in moderate concentrations. Use of regulated compositions, including those comprising hazardous elements (e.g., lead and cadmium) can optionally be eliminated from the degradable high-strength zinc alloy when so required.

As used herein the term "high strength" means the degradable high-strength zinc alloy possess intrinsic mechanical strengths, including quasi-static uniaxial tensile, shear, and compression strengths and hardness values at least equal to and typically greater than that most pure metals, and also greater than most zinc alloys and magnesium alloys. The strength of the degradable high-strength zinc alloy is such that it can withstand thousands of pounds-per-square-inch pressures for extended periods of time without damage, depending upon the needs of the applications or users.

As used herein the term "controllably reactive" refers to degradable high-strength zinc alloys that "react" in the presence of fluids typically considered non-reactive or weakly reactive to oil and gas engineering compositions. The degradable high-strength zinc alloy is engineered to either exhibit enhanced reactivity relative to the pure reactive metals, or delay the interaction of the reactive metals with the corrosive fluid. The degradable high-strength zinc alloy can also include alloys that degrade under conditions controlled by oilfield personnel.

A composition that disintegrates is one that loses structural integrity and eventually breaks down in pieces or countless small debris. As used herein the term "degradable" refers to degradable high-strength zinc alloys that are partially or wholly consumed because of their relatively high reactivity. The degradable high-strength zinc alloys that are considered reactive and degradable include those that are partially or wholly dissolvable (soluble) in the designated fluid environment, as well as those that disintegrate but do not necessarily dissolve, or which form solid byproducts such as zinc and aluminum hydroxides that may or may not be soluble depending on fluid pH. Also, the reaction byproducts of the degradable high-strength zinc alloy may not be soluble, since debris may precipitate out of the fluid environment.

As used herein, "hybrid" is used to characterize a degradable high-strength zinc alloy having distinct compositions that are used together as a part of a new and therefore more complex degradable high-strength zinc alloy because of their dissimilar reactivity, strengths, among other properties. Non-limiting examples of "hybrid" degradable high-strength zinc alloys are composites, functionally-graded compositions and other multi-layered compositions regardless of scale. In order of increasing reactivity are macro-, meso-, micro- and nanoscale compositions. These scales may be used in the degradable high-strength zinc alloy to further control reactivity, thus rate of degradation.

Non-limiting examples of articles of manufacture (apparatus) that can be partially or fully formed of the degradable high-strength zinc alloy of the present invention include oilfield components and well operating components. The degradable high-strength zinc alloy can be used to control flow (and displacement), or pressure (and force) in various applications. Flow is associated with pressure and displacement to force. One is the consequence of the other, according to Newton's law and Bernoulli's law, respectively. Apparatus or devices that are partially or fully formed of the degradable high-strength zinc alloy of the present invention may be used as flow control components, pressure control components, and the like. As used herein the term "flow control component" and "displacement control component" includes, but is not limited to, plugs, proppants, valves (including temporary flappers), seals (another means to control or restrict a flow), flotation apparatus, wherein degradation of the apparatus releases a force, such as buoyancy force, which controls displacement, and displacement apparatus, wherein the inventive apparatus controllably degrades and releases another force.

Other non-limiting examples of articles of manufacture (apparatus) that can be partially or fully formed of the degradable high-strength zinc alloy of the present invention include displacement controls that may have applications in actuators and sensors. In one non-limiting application, the actuator or sensor can include a preloaded compression spring placed against a degradable component that is partially or fully formed of the degradable high-strength zinc alloy. Upon degradation of the degradable high-strength zinc alloy, the spring releases its stored energy through a displacement. Such apparatus and their methods of use, with compressive springs or any other like devices, may find applications well beyond oilfields (e.g. in power plants, including nuclear power plants, etc.). Apparatus that are partially or fully formed of the degradable high-strength zinc alloy of the present invention include actuators, sensors, detectors, wherein degradation may not occur in the well fluids but other fluids (e.g. cooling fluids, liquid metals, etc.).

Another non-limiting example of articles of manufacture (apparatus) that can be partially or fully formed of the degradable high-strength zinc alloy of the present invention includes a moisture getter, wherein interaction of the degradable high-strength zinc alloy with moisture is used to control the humidity in a component, such as in components wherein moisture and/or humidity are not tolerated (e.g., electronic components, etc.).

In use, introduction of one or more alloying additives may function to either restrict or, on the contrary, enhance degradation of the reactive component by limiting either the rate and/or location (i.e., front, back, center or some other location of an apparatus comprising the composition), as in the example of a non-uniform material. The alloying additive may also serve to distribute loads at high stress areas, such as at a ball seat, and may function to moderate the temperature characteristic of the reactive metal such that it is not subject to excessive degradation at extreme temperature by comparison. Apparatuses of the present invention may comprise a coating, covering, or sheath upon a portion of or an entire outer surface of the reactive metal component, or the component may be embedded into a mass of the reactive metal. The reactive metal and alloying components may comprise a shape and a composition allowing degradation of the composition so that an apparatus to which the composition is originally attached may be brought outside of a wellbore by a flowing fluid, such as by pumping, or by reservoir pressure, or floatation.

The degradable high-strength zinc alloy, when used to partially or fully form oilfield components, can be used to controllably react to and, therefore, degrade when exposed to the wellbore conditions in a controlled fashion (i.e., at a rate and location controlled by the user of the application). In this way, zones in a wellbore, or the wellbore itself or branches of the wellbore, may be blocked by use of oilfield components for periods of time uniquely defined by the user. Such oilfield components may be any number of shapes (e.g., a shape that can traverse at least a portion of a wellbore and block off a perforation, or a portion of a wellbore as a wellbore plug, or to actuate (open or close) a downhole valve, or divert a fluid). Suitable shapes of oilfield components include cylindrical, round, bar shapes, dart shapes and the like axis-symmetrical and non-axis-symmetrical shapes. A 'dart shape' means that the bottom has a tapered end, in some embodiments pointed, in other embodiments truncated, flat or rounded, and the like. The oilfield component can have first and second ends that may be tapered in shape to contribute to the ease of the oilfield component traversing through a wellbore. In certain embodiments, the oilfield components have one or more passages to allow well fluids or injected fluids to contact inner portions of the oilfield component; however, this is not required. Since the diameter, length, and shape of the passages through the oilfield components can be controlled, the rate of degradation of the oilfield component can be controlled solely by mechanical manipulation of the passages, if so desired; however, this is not required. The one or more passages in the oilfield component can extend into the oilfield component a variable distance, have a certain diameter, and/or have a certain shape as desired to control the rate of degradation of the oilfield component. The rate of degradation of the oilfield component can be controlled chemically by choice of supplementary components in the degradable high-strength zinc alloy; however, this is not required. The oilfield components may comprise a structure wherein the oilfield component consists essentially of the degradable high-strength zinc alloy and which is fashioned into a plurality of strips that are positioned on or embedded in an outer surface of a relatively inert component, or some other relatively inert shaped component (such as a collet) may be embedded in the composition. In other oilfield components, the degradable high-strength zinc alloy can be formed into a plurality of strips or other shapes that are adhered to an outer surface of a relatively inert component.

The invention includes methods of using an apparatus of the invention that is partially or fully formed of the degradable high-strength zinc alloy of the present invention. One non-limiting method comprises: (a) formulating a composition of the degradable high-strength zinc alloy of the present invention; (b) shaping the composition into an apparatus or portion of an apparatus to be deployed in a defined environment; and (c) deploying the apparatus during an operation into the defined environment. The degradable high-strength zinc alloy is a high-strength, controllably reactive, and degradable composition that may or may not include one or more coatings (e.g., polymer or metal coating). The defined environment can be an oilfield environment. The apparatus can be an oilfield component.

Other methods of the invention include running one or more sensors that include the degradable high-strength zinc alloy into a wellbore using one or more oilfield components in order to define the environmental conditions of the wellbore (at least where the oilfield component is to be positioned). Other methods of the invention include degrading the apparatus or portion thereof that includes the degradable high-strength zinc alloy in the defined environment when the operation is completed, such as by application of acid, heat, or by degrading the apparatus in a user defined, controlled fashion. In certain methods of the invention, when the apparatus is an oilfield component that includes the degradable high-strength zinc alloy, the use of the oilfield component may result in a force, such as a buoyancy force, which may in turn act upon a valve, plug or other downhole component as desired by the well operator. The environmental conditions of the wellbore during running and retrieving may be the same or different from the environmental conditions during use in the wellbore or at the surface. Methods of the invention include those comprising using a first oilfield component that includes the degradable high-strength zinc alloy to close a first completion valve positioned just below a first wellbore zone to be treated, and cooling the first oilfield component using a completion fluid having a temperature lower than a temperature of the first wellbore zone. A second oilfield component that includes the degradable high-strength zinc alloy may then be used to close a second completion valve positioned above the first completion valve and just below a second wellbore zone to be treated, allowing the second oilfield component to reach the temperature of the first wellbore zone. This may be repeated multiple times for as many zones that need to be treated. The oilfield components may then be controllably degraded to be removed in pieces, or a portion of the oilfield component can be removed through controlled corrosive action and then allowed to float out of the wellbore, or at least to a point where they may be retrieved using conventional tools.

Example 1

A melting pot in the form of a ceramic crucible is embraced by a band heater such that the contents of the crucible can be heated to about 800° C. The crucible material was SiC graphite, but other materials can be used. A thermocouple type K was used to monitor the temperature during the melting of the materials in the crucible. A ceramic shell was used to protect the thermocouple from the molten alloys in the crucible. The ceramic shell can be formed of SiC. An inert atmosphere, such as an argon atmosphere, was continuously used during the heating and melting of the materials in the crucible. The inert atmosphere reduces the reaction of any calcium in the crucible with air/moisture.

The materials used to form the degradable high-strength zinc alloy of the present invention were added to the crucible and heated. The materials were added to the heated crucible when such materials were at room temperature (25-30° C.) and in the following order: (1) calcium, (2) aluminum, (3) copper, (4) lead, (5) tin, (6) zinc and (7) gallium; thus, calcium was the first element added to the heated crucible and gallium was the last. The order of addition of the elements to the heated crucible can be dictated by the density of the element; however, this is not required. The lower density elements are generally added before the higher density elements; however, this is not required. In the present example, calcium is added to the crucible prior to the addition of zinc. Zinc has a higher density than calcium; thus, when the calcium and zinc melt, the zinc penetrates into the molten calcium and not float on the top surface of the molten calcium. Such penetration of the zinc into the calcium facilitates in the reaction and alloying of the calcium and zinc. Gallium, though less dense than some of the other elements, has a lower melting point than the several of the other elements; thus, gallium melts and moves to the bottom of the element mix and/or in between the other elements before all of the elements melt. As such, the gallium will react with the other elements in the mixture when all of the elements are melted. Each of the elements can be added in irregular shape forms such as shots, rods chunks etc.; however, this is not required. Powdered elements can be used, but are not required. As can be appreciated, two or more of the elements can be added as alloys (e.g., ZnAl alloy, ZnSn, alloy, ZnAlCu alloy, etc.). The melting time of all of the elements in the crucible depends on the heating capacity of the band heater. It was observed that in the range of 430-450° C., the temperature of the mixture increased gradually up to about 600° C. in less than 5 minutes, which indicates that the molten zinc flowed to the bottom of the crucible and created an exothermic reaction with the calcium. Such reaction was found to be helpful and reduced the processing time of the mixture. Once the temperature of the materials in the crucible reached 750° C., most of the materials were in solution; however, some of the elements may still be in solid form. In the present example, it took about 30 minutes to fully melt all of the elements in the crucible to form the alloy of $ZnAl_{27}Cu_2Sn_1Pb_1Ca_8Ga_1$. The temperature of the molten alloy mixture was about 750-800° C. The molten alloy was mixed and skimmed before pouring onto a steel mold. Thereafter, the alloy was cooled to room temperature. The formed alloy was then formed in two parts to facilitate the ejection of the casted part.

Example 2

AZ27 ingots (i.e., 25-28 wt. % aluminum, 2-2.5 wt. % copper, 0.01-0.02 wt. % magnesium, up to 0.75 wt. % iron, up to 0.006 wt. % lead, up to 0.006 wt. % calcium, up to 0.003 wt. % tin, and balance zinc) were obtained from a commercial source. The ingots were placed in a steel crucible and heated to 650-700° C. until fully molten. 8 wt. % calcium metal, 2 wt. % tin metal, and 1 wt. % gallium metal were added to the molten AZ27 alloy and stirred until completely melted. The alloy was poured into a steel mold. After pouring, the sample was solidified. The structure of the formed alloy is illustrated in FIG. 4. Dissolution rates in an acceptable range were measured at 34 mg/cm$^2$/hr. and a hardness of 87 Rockwell B scale. A cast portion of the alloy near the base of the casting (low porosity) was hot mounted, ground and polished, using a similar procedure as magnesium-based alloys. The results (shown un-etched) were acceptable with few scratches. Three distinct regions of the casting were imaged at 100× (top row) and 400× (bottom row). While 8 wt. % calcium was added, the amount in the casting will be less than 8 wt. % calcium, and could be as low as 2 wt. % calcium, as the calcium forms a dense intermetallic that is still solid at 650° C., which has a tendency to separate if not continuously stirred.

Example 3

A melting pot in the form of a plain carbon steel crucible was placed in a laboratory scale gas fired-furnace such that the contents of the crucible can be heated to about 850° C. The crucible material was plain carbon steel, but other materials can be used. A thermocouple type K was used to monitor the temperature during the melting of the materials in the crucible. An inert atmosphere such as, but not limited to, an argon atmosphere, was continuously used during the heating and melting of the materials in the crucible. The inert atmosphere was used to reduce the reaction of any magnesium and/or zinc in the crucible with air/moisture. The materials used to form the high-strength zinc alloy of the present invention were added to the crucible and heated. The materials were added to the heated crucible when such materials were at room temperature (25-30° C.) and in the following order: (1) magnesium and (2) zinc. The weight fraction was approximately 50 wt. % magnesium and 50 wt. % zinc. The order of addition of the components to the heated crucible can be dictated by the density of the components; however, this is not required. The lower density components are generally added before the higher density components; however, this is not required. In the present example, magnesium is added to the crucible prior to the addition of zinc. Zinc has a higher density than magnesium; thus, when the magnesium and zinc melt, the zinc penetrates into the molten magnesium and not float on the top surface of the molten magnesium. Such penetration facilitates in the reaction and alloying of the magnesium and zinc. Each of the components can be added in irregular shape forms such as shots, rods chunks etc.; however, this is not required. Powered components can be used; but are not required. The melting time of all of the components in the crucible at least partially depends on the heating capacity of the furnace (e.g., gas furnace, etc.). Once the temperature of the molten alloy mixture was about 850° C., the melt was allowed to cool naturally (e.g., turning off furnace) to a temperature of 550° C. During this cooling time, the inert argon gas atmosphere was maintained over the melt in the crucible. The molten alloy was then removed from the furnace, mixed, and skimmed before pouring onto a steel mold approximately 1" in diameter. Thereafter, the alloy was cooled to room temperature (e.g., 25-30° C.). The resulting hardness of the cast alloy was 90-100 HRB and the dissolution rate of the cast alloy in a 3 wt. % KCl solution at 90° C. was 27 mg/cm$^2$/hr.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A degradable high-strength zinc alloy which includes a) more than 50 wt. % zinc, 1.5-15 wt. % calcium, and three or more of aluminum, copper, magnesium, lead, tin, gallium, lithium, sodium, and strontium, or b) at least 50 wt. % zinc and 2-45 wt. % magnesium and three or more of aluminum, copper, calcium, lead, tin, and gallium; said degradable high-strength zinc alloy having a degradation rate of one or more of i) about 10-150 mg/cm$^2$/ hr. in a 3 wt. % KCl fluid at a temperature of 90° C., ii) 0.1-75 mm/day at 50-135° C. in fresh water, iii) 0.1-75 mm/day at 50-135° C. in salt water or iv) 0.01-30 mm/day in a 3 wt. % KCl fluid at a temperature of 90° C.

2. A degradable high-strength zinc alloy which includes more than 50 wt. % zinc, 1-15 wt. % calcium, 0.1-5 wt. % tin, and two or more of magnesium, aluminum, copper, lead, and gallium; said degradable high-strength zinc alloy having a degradation rate of one or more of about a) 0.01-30 mm/day in a 3 wt. % KCl fluid at a temperature of 90° C., b) about 10-150 mg/cm$^2$/hr. in a 3 wt. % KCl fluid at a temperature of 90° C., c) 0.1-75 mm/day at 50-135 ° C. in fresh water, or d) 0.1-75 mm/day at 50-135° C. in salt water.

3. The degradable high-strength zinc alloy as defined in claim 2, wherein a source of said zinc in said degradable high-strength zinc alloy is selected from the group consisting of Zamak, Zn—Li, Zn—Mg, Zn—Al (ZA), ZA27, ZA12, EZAC, Zn—Li, or other zinc prealloy.

4. The degradable high-strength zinc alloy as defined in claim 2, wherein said degradable high-strength zinc alloy is formed using a powder metallurgy process.

5. The degradable high-strength zinc alloy as defined in claim 2, wherein said degradable high-strength zinc alloy is formed by adding alloying or particle additives to a molten zinc or zinc alloy.

6. The degradable high-strength zinc alloy as defined in claim 2, wherein said degradable high-strength zinc alloy is formed by melting the components at a temperature and for a time suitable to form a homogeneous liquid, and then solidifying the melt to create a multiphase solid.

7. The degradable high-strength zinc alloy as defined in claim 2, wherein said degradable high-strength zinc alloy is modified while maintaining degradability by heat treatment, extrusion, forging, or other process to increase mechanical properties and/or alter the size, amount, and distribution of second phases and/or grain sizes in said degradable high-strength zinc alloy.

8. The degradable high-strength zinc alloy as defined in claim 2, wherein said degradable high-strength zinc alloy is fabricated into a component or tool useful for oil and gas operations selected from the group consisting of a ball, plug, mandrel, slip, grip, button, sleeve, dart, diverter, rod, wire, and strip.

9. A degradable tool that is at least partially formed from the degradable high-strength zinc alloy as defined in claim 2.

10. The degradable high-strength zinc alloy comprising over 50 wt. % zinc, 1-15 wt. % calcium, 0.1-5 wt. % tin, 0.1-5 wt. % gallium, and one or more of magnesium, aluminum, copper, and lead; said degradable high-strength zinc alloy having a degradation rate of one or more of about a) 0.01-30 mm/day in a 3 wt. % KCl fluid at a temperature of 90° C., b) about 10-150 mg/cm$^2$/ hr. in a 3 wt. % KCl fluid at a temperature of 90° C., c) 0.1-75 mm/day at 50-135° C. in fresh water, or d) 0.1-75 mm/day at 50-135° C. in salt water.

11. A degradable tool that is at least partially formed from a degradable high-strength zinc alloy, said degradable high-strength zinc alloy which includes more than 50 wt. % zinc, 1-15 wt. % calcium, 0.1-5 wt. % tin, and two or more of magnesium, aluminum, copper, lead, and gallium; said degradable high-strength zinc alloy having a degradation rate of one or more of a) about 10-150 mg/cm$^2$/ hr. in a 3 wt. % KCl fluid at a temperature of 90° C., b) 0.1-75 mm/day at 30-180° C. in fresh water, c) 0.1-75 mm/day at 30-180° C. in salt water, or d) 0.01-30 mm/day in a 3 wt. % KCl fluid at a temperature of 90° C.

12. The degradable tool as defined in claim 11, wherein said degradable high-strength zinc alloy includes three or more of aluminum, copper, magnesium, lead, and gallium.

13. The degradable tool as defined in claim 11, wherein said degradable high-strength zinc alloy includes at least 2 wt. % of one or more elements selected from the group of aluminum, magnesium, calcium, lithium, sodium, and strontium, said degradable high-strength zinc alloy further alloyed with 0.5-15 wt. % of an electronegative alloying additive, said electronegative alloying additive having an electronegativity greater than 1.75.

14. The degradable tool as defined in claim 11, wherein said degradable high-strength zinc alloy alloyed includes 0.5-15 wt. % of one or more electropositive additives, said electropositive additives having an electronegativity of less than or equal to 1.65.

15. The degradable tool as defined in claim 11, wherein said degradable high-strength zinc alloy is formed using a molding or casting process.

16. The degradable tool as defined in claim 11, wherein said degradable high-strength zinc alloy has a shear strength of at least 35,000 psi, and a tensile ultimate strength of at least 50 KSI.

17. The degradable tool as defined in claim 11, wherein said degradable high-strength zinc alloy includes at least 2 wt. % of one or more elements selected from the group of aluminum, magnesium, calcium, lithium, sodium, and strontium; said degradable high-strength zinc alloy further alloyed with 0.5-15 wt. % of an electronegative alloying additive; said electronegative alloying additive having an electronegativity greater than 1.75; said degradable high-strength zinc alloy includes 1-15 wt. % calcium, 0.1-5 wt. % tin, 0.1-5 wt. % gallium, and one or more of magnesium, aluminum, copper, and lead.

* * * * *